US010584863B1

(12) United States Patent
Mittal et al.

(10) Patent No.: US 10,584,863 B1
(45) Date of Patent: Mar. 10, 2020

(54) LIGHT EMITTING DIODE LUMINAIRE

(71) Applicant: Overdrive Electronics Pvt. Ltd., Noida, G.B. Nagar (IN)

(72) Inventors: Mohit Mittal, G.B. Nagar (IN); Nagesh Chandra Nath, G.B. Nagar (IN); Manish Kumar Pandey, G.B. Nagar (IN)

(73) Assignee: Overdrive Electronics Pvt. Ltd. (IN)

( * ) Notice: Subject to any disclaimer, the term of this patent is extended or adjusted under 35 U.S.C. 154(b) by 0 days.

(21) Appl. No.: 16/406,639

(22) Filed: May 8, 2019

(51) Int. Cl.

| | |
|---|---|
| ***F21V 29/70*** | (2015.01) |
| ***F21V 29/89*** | (2015.01) |
| ***F21V 3/06*** | (2018.01) |
| ***F21K 9/237*** | (2016.01) |
| ***F21V 31/00*** | (2006.01) |
| ***F21V 19/00*** | (2006.01) |
| ***F21V 23/00*** | (2015.01) |
| *F21Y 115/10* | (2016.01) |

(52) U.S. Cl.
CPC ..... *F21V 29/70* (2015.01); *F21K 9/237* (2016.08); *F21V 3/0625* (2018.02); *F21V 19/003* (2013.01); *F21V 23/006* (2013.01); *F21V 29/89* (2015.01); *F21V 31/005* (2013.01); *F21Y 2115/10* (2016.08)

(58) Field of Classification Search
CPC ..... F21V 29/70; F21V 31/005; F21V 19/003; F21V 23/006; F21V 29/89; F21V 3/0625; F21K 9/237; F21Y 2115/10
See application file for complete search history.

(56) References Cited

U.S. PATENT DOCUMENTS

| | | | | |
|---|---|---|---|---|
| 9,534,773 | B1 * | 1/2017 | Turudic | F21V 23/005 |
| 2010/0314985 | A1 * | 12/2010 | Premysler | F21V 3/02 313/46 |
| 2016/0273716 | A1 * | 9/2016 | Tarsa | F21K 9/61 |

* cited by examiner

*Primary Examiner* — Kevin Quarterman
(74) *Attorney, Agent, or Firm* — Locke Lord LLP; Peter J. Fallon

(57) ABSTRACT

Described herein is a light emitting diode (LED) luminaire comprising a cylindrical plastic housing having a first open end and a second open end. At the first open end, an externally threaded formation terminating with a flange is formed to mate with an internally threaded mounting unit, and at the second open end, an internal ridge is formed with a circumferential groove at its base. Inside the cylindrical plastic housing, an aluminum heat sink is insert molded. The aluminum heat sink has a cylindrical profile matching with the internal profile of the plastic housing. The aluminum heat sink has an open end towards the first open end of the plastic housing and a closed end resting on the internal ridge at the second open end of the plastic housing. With the interior surface of the closed end of the aluminum heat sink, a printed circuit board (PCB) holder plate locks a PCB driver. At an exterior surface of the closed end of the aluminum heat sink, metal core PCB (MCPCB) for LED is mounted at an exterior surface of the closed end of the aluminum heat sink and is connected to the PCB driver for receiving driving current. On the top of the MCPCB, a plastic diffuser is mechanically locked in the circumferential groove formed at the base of the internal ridge so as to cover the MCPCB for LED.

9 Claims, 10 Drawing Sheets

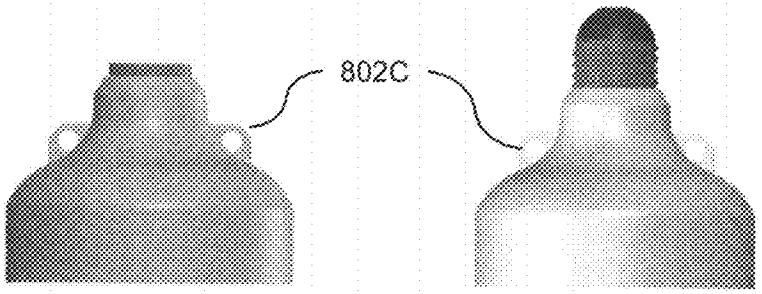
FIG. 8B
FIG. 8C
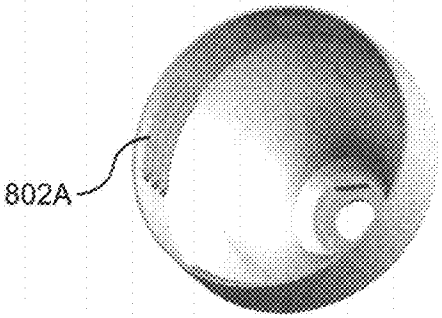
FIG. 8D
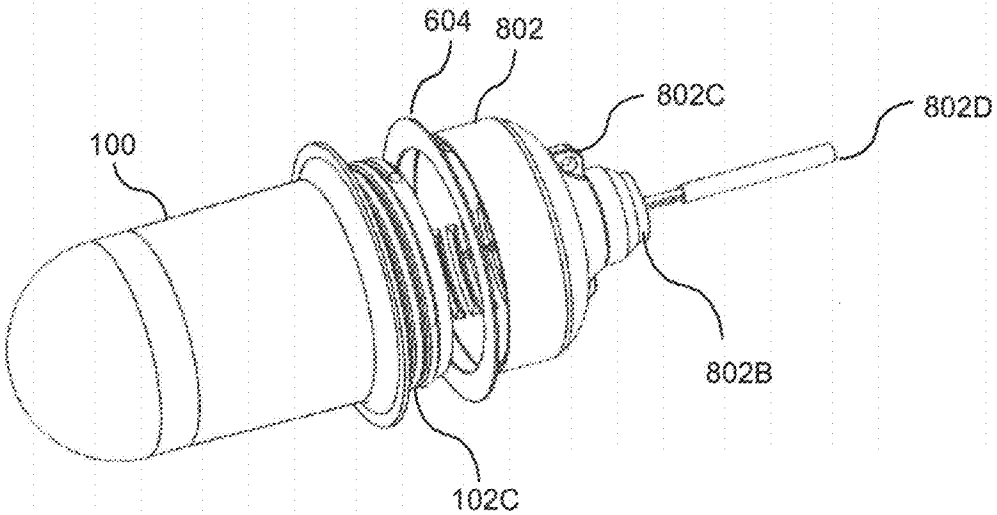
FIG. 8A

LIGHT EMITTING DIODE LUMINAIRE

TECHNICAL FIELD

The present disclosure, in general, relates to the luminaire and, in particular, relates to a luminaire having light emitting diodes (LEDs).

BACKGROUND

Background description includes information that may be useful in understanding the present invention. It is not an admission that any of the information provided herein is prior art or relevant to the presently claimed invention, or that any publication specifically or implicitly referenced is prior art.

Light emitting diode (LED) devices are more efficient than most forms of widely used lamps, for example, incandescent, high-intensity discharge (HID) light sources, and the like. One advantage of using LED devices is that LEDs are more efficacious than incandescent light and more efficacious than some fluorescent and low wattage HID light sources. Another advantage of LED device usage is that the LEDs may be configured as low voltage, low energy devices. Another advantage of the LED devices is that of the longer life when compared to other light forms.

Along with these advantages, one perceived disadvantage with the LED devices is that LEDs produce heat energy during their operation. This heat energy increases the temperature of LED devices in which LEDs are in. This, in turn, may reduce the performance and life of not only the LED themselves, but of the entire LED device. Therefore, one of the primary challenges in fully commercializing LED device is the solution to the thermal management of the heat generated by the LED device in a cost-effective manner.

Therefore, there is a need for a device or an LED device for obtaining good heat management in a cost-effective manner.

SUMMARY

This summary is provided to introduce concepts related luminaire having light emitting diodes. The concepts are further described below in the detailed description. This summary is not intended to identify key features or essential features of the claimed subject matter, nor is it intended to be used to limit the scope of the claimed subject matter.

In an embodiment, the present disclosure relates to a light emitting diode (LED) luminaire comprising a cylindrical plastic housing having a first open end and a second open end, At the first open end, an externally threaded formation terminating with a flange is formed to mate with an internally threaded mounting unit, and at the second open end, an internal ridge is formed with a circumferential groove at its base. Inside the cylindrical plastic housing, an aluminum heat sink is insert molded. The aluminum heat sink has a cylindrical profile matching with the internal profile of the plastic housing. The aluminum heat sink has an open end towards the first open end of the plastic housing and a closed end resting on the internal ridge at the second open end of the plastic housing. With the interior surface of the closed end of the aluminum heat sink, a printed circuit board (PCB) holder plate locks a PCB driver. At an exterior surface of the closed end of the aluminum heat sink, metal core PCB (MCPCB) for LED is mounted at an exterior surface of the closed end of the aluminum heat sink and is connected to the PCB driver for receiving driving current. On the top of the MCPCB, a plastic diffuser is mechanically locked and glued to make vapor tight joint in the circumferential groove formed at the base of the internal ridge so as to cover the MCPCB for LED.

Various objects, features, aspects, and advantages of the inventive subject matter will become more apparent from the following detailed description of preferred embodiments, along with the accompanying drawing figures in which like numerals represent like components.

BRIEF DESCRIPTION OF THE DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and methods that are consistent with the subject matter as claimed herein, wherein:

FIGS. 8A-SD illustrate various views of a hanging mounting unit, in accordance with an embodiment of the present disclosure.

DETAILED DESCRIPTION

Figure 1A:
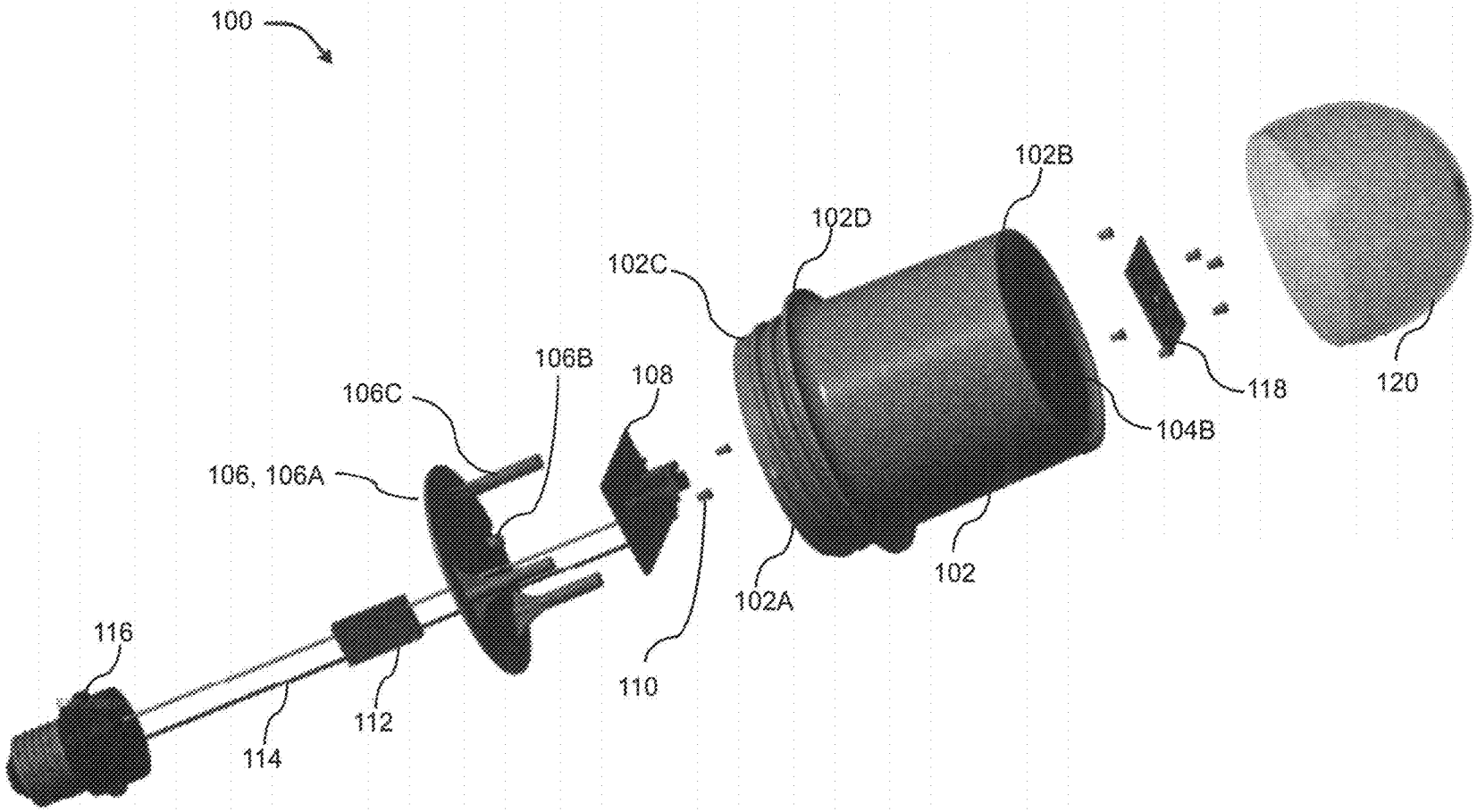
FIG. 1A illustrates an exploded view of the light emitting diode (LED) luminaire, in accordance with an exemplary embodiment of the present disclosure.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The present disclosure aims to solve a technical problem of improving the assembly convenience of a light emitting diode (LED) luminaire or device or the like and reduce the heat generated in said assembly.

For heat management in LED devices, most of the manufacturers have used aluminum core circuit boards onto which LEDs are surface mount soldered. However, such aluminum core boards have limited surface area to dissipate heat. Also, the LED devices cannot be easily interchanged to either replace defective units or to change the product color.

In order to reduce the effect of this detrimental energy, heat sinks are attached to the LED devices. The heat sinks provide a means for removing the energy from the LED device through convection and radiation of the heat energy away from the LED device. Accordingly, the energy loss from a heat sink occurs through natural convection, forced convection, or radiation. The effectiveness of the heat sink in pulling energy away from the LED device is dependant on the ability to spread or dissipate the heat generated from what is often a small source over a larger area so that it can be removed through the flow of air over the surface or by radiation to the environment.

In effect, as long as the heat generated by the LED devices to be cooled can be effectively spread over a larger surface, the effectiveness of the heat sink is primarily dependent on the amount of available surface area. Whether the material is a conductor throughout its body or just on the surface does not affect its ability to transfer heat to the environment.

Heat management in the LED devices that are becoming smaller, lighter, and more compact is an ever-increasing challenge. Historically, the heat sinks used to dissipate the energy have been made of metals such as zinc, aluminum, or copper, and can be either machined, cast or extruded. Because the heat sinks are made of metal, the heat sinks are often heavy. As the LED devices become smaller and the need to reduce part weight and cost increases, alternative methods to control heat must be found. Furthermore, since the LED devices are electrical conductors, the attachment of heat sinks to the LED devices requires modifications to the heat sink so that electrical circuitry providing either signals or power can be provided without shorting such electrical circuitry to the metal heat sink.

Figure 1B:
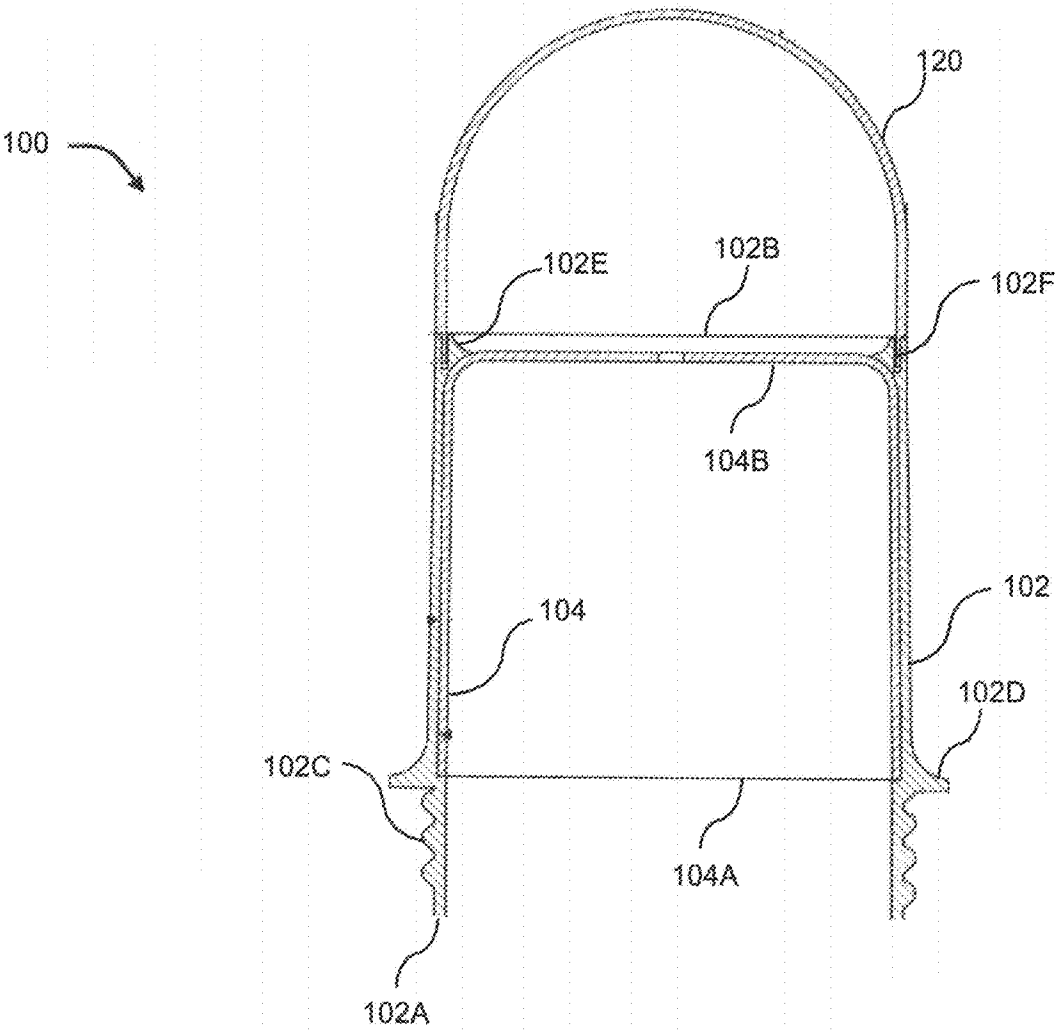
FIG. 1B illustrates an assembled view of the LED luminaire, in accordance with an exemplary embodiment of the present disclosure FIGS. 2A and 2B schematically illustrate a process of assembling a printed circuit board (PCB) driver on a PCB holder plate, in accordance with an exemplary embodiment of the present disclosure.

To this, the present disclosure provides an LED luminaire 100 as shown in FIGS. 1A and 1B, in accordance with an exemplary embodiment. The LED luminaire 100 can be easily converted to a conventional utility fixture using Incand.

The LED luminaire 100 includes a cylindrical plastic housing 102 having a first open end 102A and a second open end 102B. On the first open end 102A, an externally an externally threaded formation 102C terminating with a flange 102D is formed so as to mate with an internally threaded mounting unit. On the second open end 102B, an internal ridge 102E is formed along with a circumferential groove 102F at its base.

Further, an aluminum heat sink 104 is insert molded inside the cylindrical plastic housing 102. The aluminum heat sink 104 has a cylindrical profile matching with the internal profile of the plastic housing 102. The aluminum heat sink 104 has an open end 104A towards the first open end 102A of the plastic housing 102 and a closed end 104B resting on the internal ridge 102E at the second open end 102B of the plastic housing 102.

With such configuration of the plastic housing 102 and the aluminum heat sink 104, good heat transfer from LED luminaire 100 to the outer surface for further heat dissipation to the ambient. Also, on the surface of the closed end 104B of the aluminum heat sink 104, internal holes are formed to match with connecting points of standard printed control boards (PCBs). Such internal holes provide ease of assembly of a PCB holder plate 106 within the aluminum heat sink 104. In an example, the plastic housing 102 has a thickness of 1.2 mm, and the aluminum heat sink has a thickness of 0.8 mm.

The PCB holder plate 106 includes a circular base 106A for holding and locking a PCB driver 108 with an interior surface of the closed end 104B of the aluminum heat sink 104. The circular base 106A includes two pillars 106B on which the PCB driver 108 is mechanically locked using fasteners 110. In an example, the fasteners 110 are screws. Further, the circular base 106A includes three tower shaped legs 106C which are mechanically locked with the interior surface of the closed end 104B of the aluminum heat sink 104 using the fasteners 110.

The PCB driver 108 held by the PCB holder plate 106 is connected to an electrical connector 112 having insulated wires 114 connected to a power supply source (not shown in figures). In an alternative example, the insulating wires 114 may be connected to a CFL or bulb and 116 for receiving power supply through conventional utility fixture.

Further, on an exterior surface of the closed end 104B of the aluminum heat sink 104, a metal core printed circuit board (MCPCB) 118 for mounting of LEDs are mounted and connected to the PCB driver 108 for receiving driving current from the power supply source.

Once the MCPCB 118 is mounted and connected, a plastic diffuser 120 is mechanically locked in the circumferential groove 102F formed at the base of the internal ridge 102E so as to cover the MCPCB 118 for the LEDs. In an example, the diffuser 120 is mechanically locked and glued in the groove 102F to make the LED luminaire 100 suitable for use in wet locations. In an implementation, the groove 102F is filled with silicone glue all around to make this water and vapor tight After the mounting of the plastic diffuser 120, jelly jar replacement retrofit kit, i.e., LED luminaire 100 is formed which has a similar shape as that of jelly jar used in utility light fixtures. The LED luminaire 100 is better & more cost effective, easy to assemble, easy to mass produce to meet large market requirements, and easy to mount on LED-based lamps and fixtures in comparison to the conventional type of LED devices & fixtures.

Further, the special shaped heat sink 104 would be able to transfer the heat more effectively. This is possible due to the combination of highly conductive aluminum (Al) or similar metal having conductivity above 100 w/m-K and an electrically insulated housing made of plastic material like polybutylene terephthalate (PBT) or polyamide (nylon) having a lower conductivity up to 2w/m-k but with complete electrical insulation properties. The combination of the two parts, i.e., metal and plastic, molded or assembled together is so designed to optimize the material's cost, manufacturing costs, thermal management, application, meeting ANSI dimensional requirements, and manufacturing process, based on various materials and designs of the heat sink.

For instance, in an implementation, the heat transfer is directly proportional to the conductivity of the material, thermal emissivity coefficient, and delta T (ambient and exposed body surface temperature). With this as the basis, and to increase the heat transfer rate from the housing composite of plastic and aluminum, the housing composite of the present disclosure is achieved by adapting the following advancement in the existing technology:

- Increased Conductivity by increasing the contact of plastic & metal: Metal to plastic contact by creating special shapes of the aluminum heat sink to increase the contact area with the less conductive plastic material. This is done by molding of the aluminum insert with the plastic at the same time.
- Improved Delta T: This is achieved by this special shape of the plastic as the aluminum is spread out due to special unique shape. Thus, giving better Delta T to the plastic surface with ambient.
- Improved Emissivity: Due to the special shape of the aluminum insert, the temperature on the plastic heat sink body was more evenly spread and thus giving it higher temperature, thereby improving its emissivity throughout the body.
- Ease of Manufacturing: The metal part is designed in such a manner that it can be manufactured by simple deep drawing or spinning process or a combination of stamping, drawing and spinning.
- Good thermal Conductivity: The top part of the heat sink where the MCPCB 118 with LED is mounted is designed for reducing any losses and also helps to easily transport the heat throughout the aluminum heat sink 104.

The LED luminaire 100 of the present disclosure has applications in agriculture lighting, commercial & industrial lighting, animal confinement, tunnels, corridor, walkways, refrigerators, freezers, kitchen hoods and area where Vapor Tight are required.

Figure 2B:
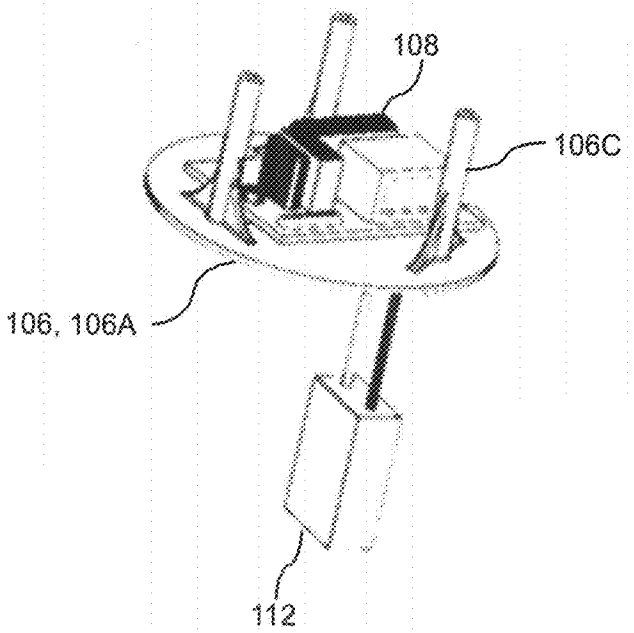
Figure 2A:
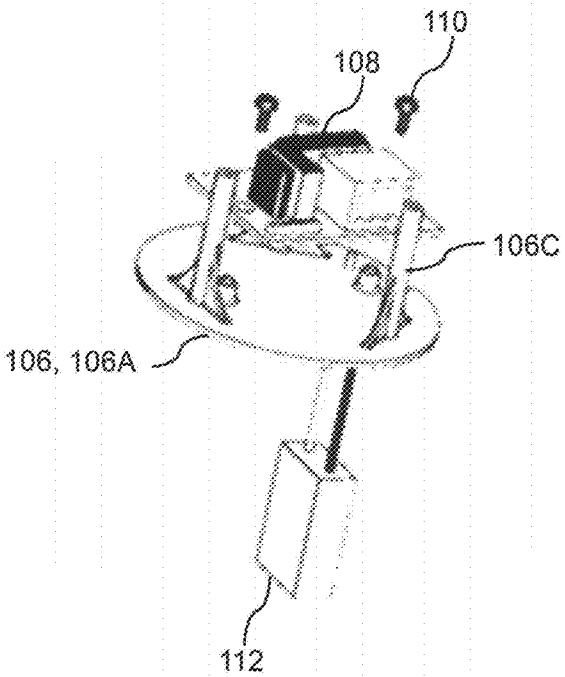

Although the construction of the LED luminaire 100 is described above in detail, assembling of the LED luminaire 100 initiates with PCB driver 108 mounting on the PCB holder plate 106. As can be seen from FIGS. 2A and 2B, the PCB driver 108 is mounted over a plastic insert in the PCB holder plate 106 using two metal screws 110.

Figure 3A:
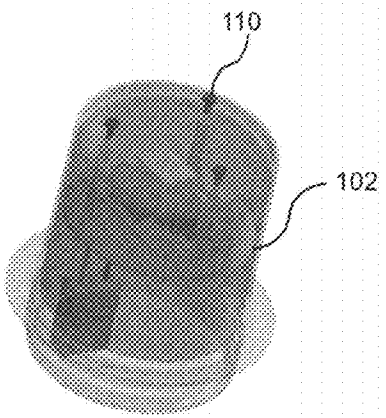
FIGS. 3A-3D schematically illustrate a process of assembling different components of the LED luminaire, in accordance with an exemplary embodiment of the present disclosure.
Figure 3B:
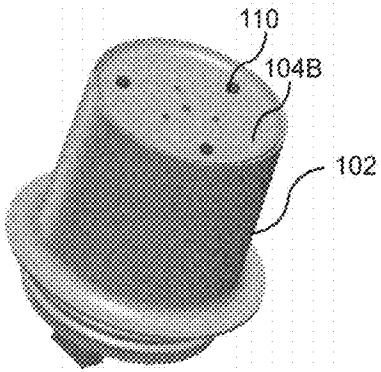

Thereafter, the PCB holder plate 106 along with the PCB driver 108 in fit into the housing 102. As shown in FIG. 3A, the PCB holder plate 106 along with the PCB driver 108 is inserted into the housing 102 and is about to be fixed using three holes formed on the surface of closed end 104B of the aluminum heat sink 104. The PCB holder plate 106 has three tower shaped legs 106C which are mechanically locked with the surface of the closed end 104B of the aluminum heat sink 104 using the metal screws. An assembled PCB holder plate 106 or the PCB driver 108 is shown in FIG. 3B.

Figure 3C:
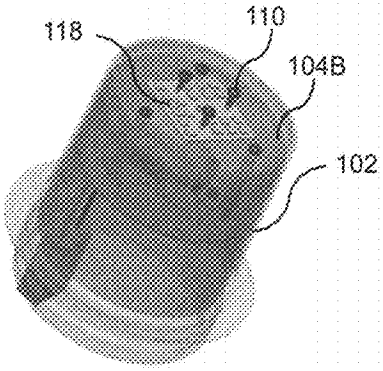
Figure 3D:
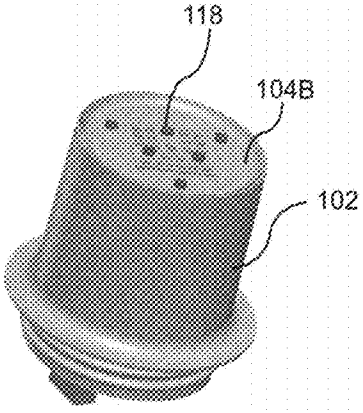

Thereafter, the LED mounted MCPCB 118 is fit over their specified position with the help of three metal screws 110. FIGS. 3C and 3D show images indicating before and after the image of LED mounted MCPCB 118 assembly process. After the assembly of the MCPCB 118, an output wire of the PCB driver 108 is soldered on the MCPCB 118 at respective electric points.

Although the all the fasteners or metal screws are marked with reference numeral 110, two different types of screws are used in the present disclosure. For instance, screws with 5 mm diameter are used for PCB or MCPCB mounting, while screws of 8 mm diameter are used for other applications. The dimensions of the screws are not be read as restrictive and can be modified based on the shape and size of the LED luminaire 100.

Figure 4:
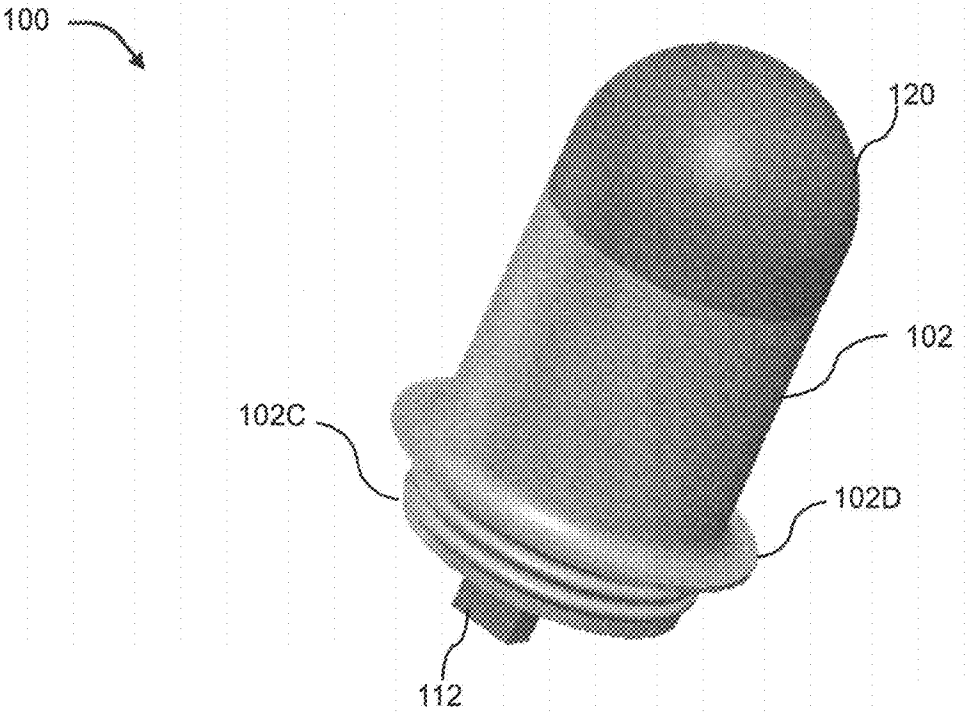
FIG. 4 illustrates a schematic view of a completely assembled LED luminaire, in accordance with the present disclosure.

Once the soldering of the output wires at the respective electric points on the MCPCB 118 is completed, the diffuser 120 is fitted over the housing 102 with the help of a silicon glue. FIG. 4 illustrates a complete assembly of the LED luminaire 100.

The complete assembly of the LED luminaire 100 can be mounted for application through its an externally threaded formation 102C. The externally threaded formation 102C is formed to mate with an internally threaded mounting unit.

Figure 5:
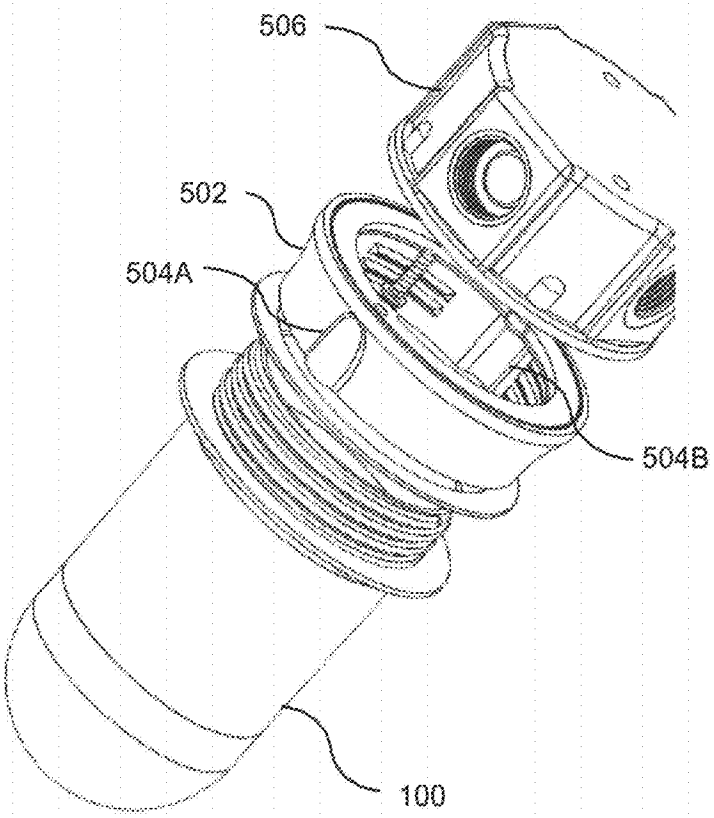
FIG. 5 illustrates an exploded unassembled view of the LED luminaire with its mounting unit, in accordance with an embodiment of the present disclosure.

In an embodiment as shown in FIG. 5, the internally threaded mounting unit is a cylindrical plastic adapter 502 formed with at least two bosses 504A, 504B with respective fastener holes to allow fasteners 110 to be inserted into the fastener holes to abut against a metallic conventional junction box 506.

Figure 6B:
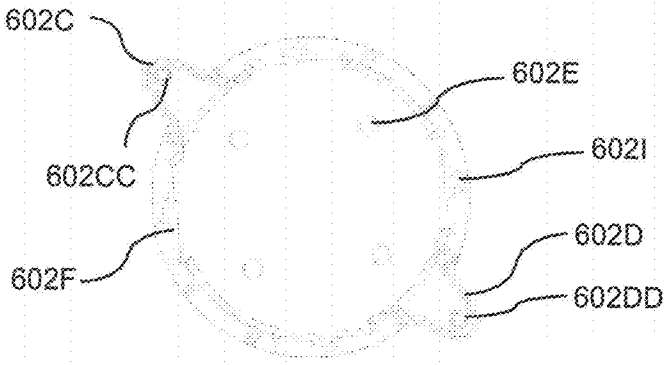
FIGS. 6A-6C illustrate various views of a plastic junction box, in accordance with an embodiment of the present disclosure.
Figure 6C:
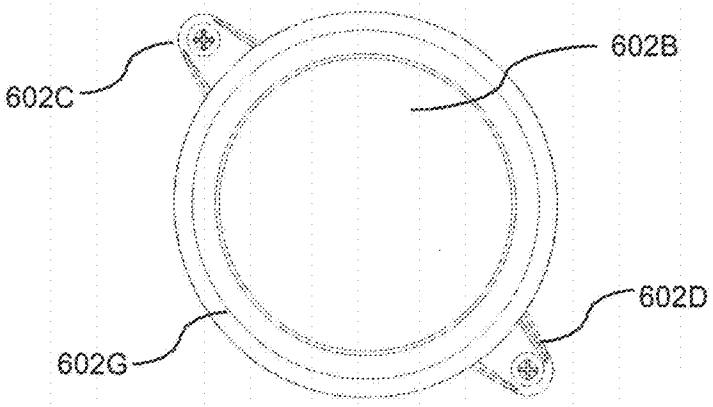
Figure 6A:
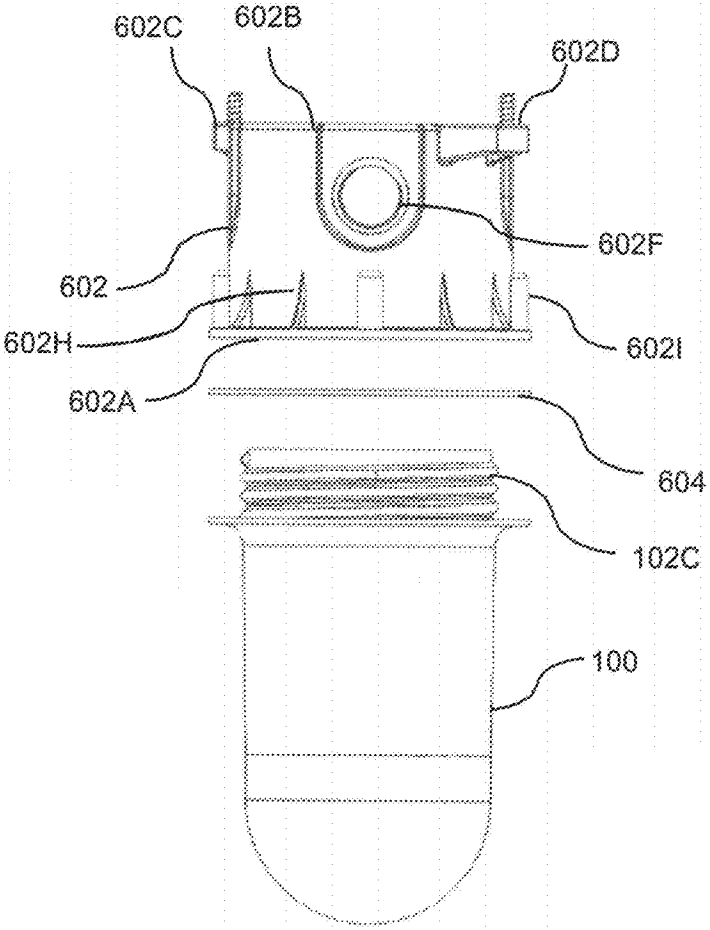

In an alternative embodiment as shown in FIGS. 6A-6C, the internally threaded mounting unit is a cylindrical plastic junction box 602 having an open end 602A and a closed end 602B. The cylindrical plastic junction box 602 further includes at least two flanges 602C, 602D at a base formed at the closed end 602B. The two flanges 602C and 602D are provided with an option of ribs at both sides of flanges to provide mechanical strength to the over the body of the junction box 602. The two flanges 602C and 602D include fastener holes 602CC and 602DD to allow fasteners 110 to be inserted into the fastener holes 602CC and 602DD to abut against a ceiling or a wall. Although the two flanges 602C and 602D are shown in FIGS. 6A-6C, those skilled in the art can appreciate that the junction box 602 without these flanges are within the scope of the present disclosure.

Further, the cylindrical plastic junction box 602 includes at least four fastener holes 602E formed on the base to allow the fasteners 110 to be inserted into the fastener holes 602E to abut against the ceiling or the wall. The fastener holes 602E will provide an option for fitting junction box 602 at wall/roof as per requirement. Also, the cylindrical plastic junction box 602 includes at least four PVC conduit fitting slots 602F in walls of the cylindrical plastic junction box 602. The PVC conduit fitting slots 602F are covered with a removable material which can be knocked out for PVC conduit fitting of "& %" size or other required sizes. The PVC conduit fitting is fixed with the help of thread available at each of them. Also, there is enough length at each of the PVT conduit fitting slots 602F, both internal & external to the cylindrical plastic junction box 602, which will not make a PVC conduit to slip off, and thereby providing tight fitting to the PVC conduits.

The cylindrical plastic junction box 602 includes a gasket face 602G on open end 602A. The gasket face 602G has enough thickness to provide mechanical strength to the body of the cylindrical plastic junction box 602. The gasket face 602G protrudes outside the walls of the cylindrical plastic junction box 602. Further, at least twelve ribs 602H formed below the gasket face 602G on the walls to provide strength to the gasket face 602G, so that if by mistake someone tight thread to its breaking point then, in that case, these ribs 602H will provide strength to the structure.

Also, the cylindrical plastic junction box 602 includes at least four bosses 602I formed on the gasket face 602G with respective fastener holes to allow fasteners to be inserted into the fastener holes to abut a wall mounting adapter 702 with the cylindrical plastic junction box 602. Also, the bosses 602I over a screw tighten position will not allow making any exposed metallic part over the body of the cylindrical plastic junction box 602.

Further, the cylindrical plastic junction box 602 is so designed that there would be enough space inside the junction box 602 for wire and extra connector to place inside the body.

Yet further, in an example, a silicon gasket 604 is used at indicated position to provide watertight sealing between the LED luminaire 100 and the junction box 602.

Figure 7B:
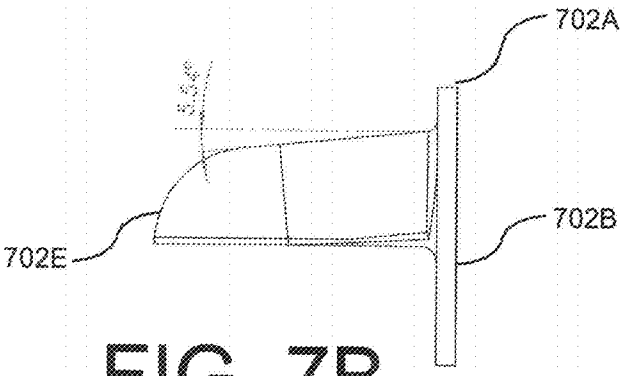
FIGS. 7A-7C illustrate various views of a wall mount adapter in accordance with an embodiment of the present disclosure.
Figure 7C:
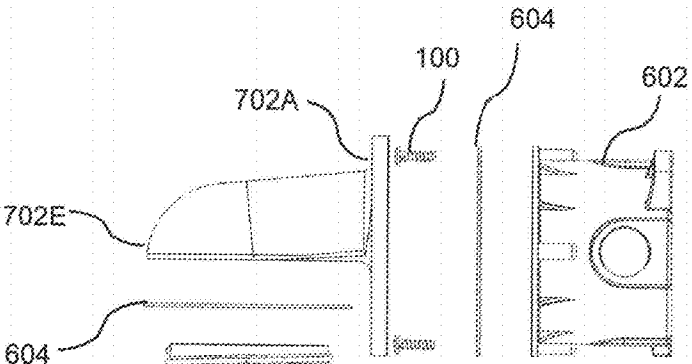
Figure 7A:
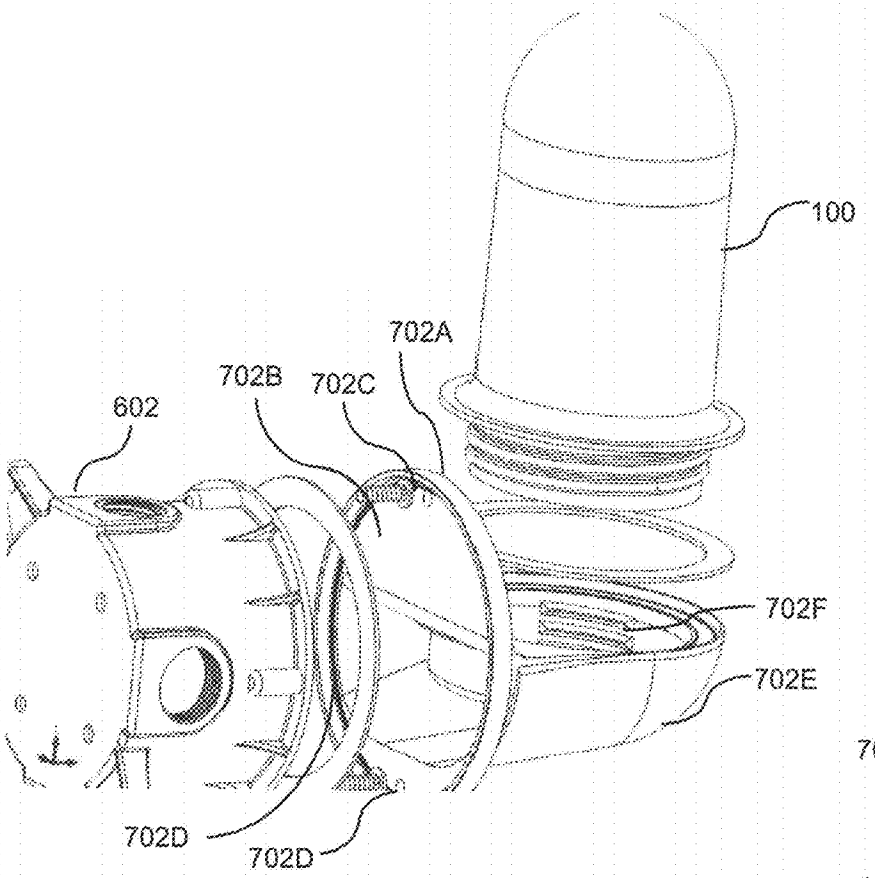
Figure 9B:
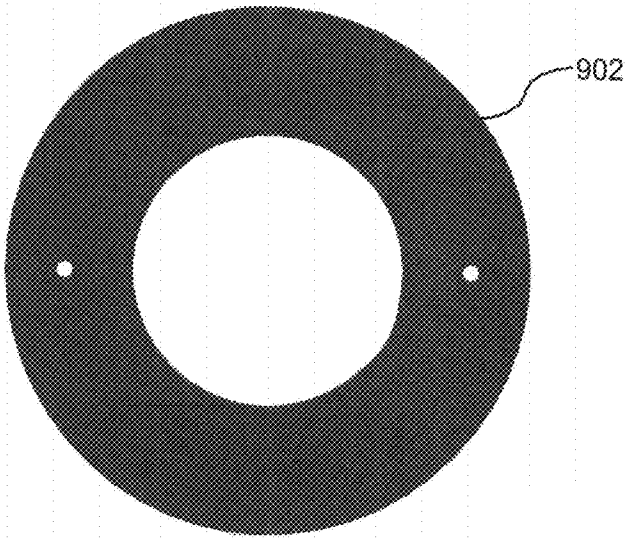
FIGS. 9A-9B illustrate various views of a metallic disc plate, in accordance with an embodiment of the present disclosure.
Figure 9A:
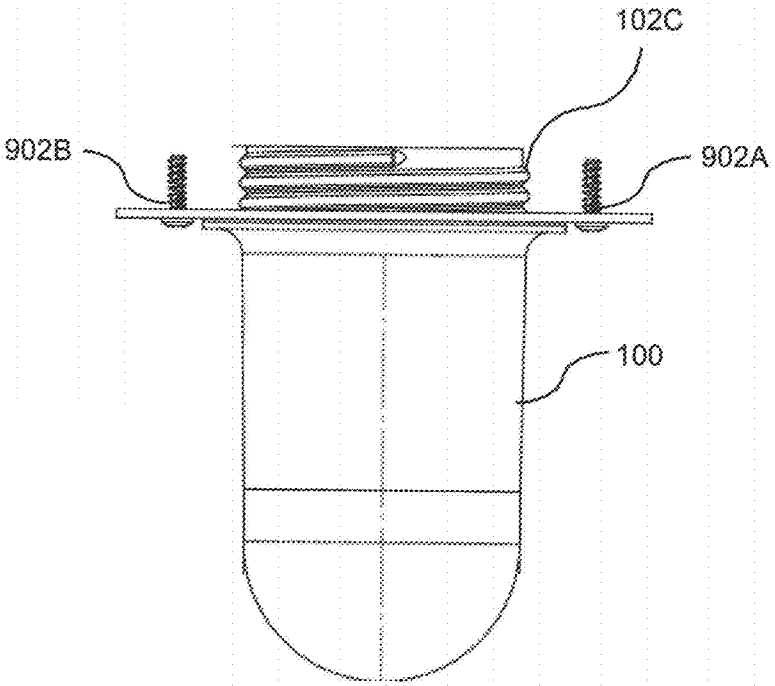

In an alternative embodiment as shown in FIGS. 7A-7C, the internally threaded mounting unit is a wall mounting adapter 702 which is directly fixed on the wall or fixed on the wall through the cylindrical plastic junction box 602. The wall mounting adapter 702 includes a circular base 702A mechanically mountable on the wall directly or through the junction box 602, and a gasket face 702B formed on the circular base 702A on a side facing the wall or the junction box 602. The gasket face 702B includes at least two circular ribs 702C at gasket fitting section for tight mounting. On the back side of wall mounting adapter 702, a wall in the internal body is designed for two purposes, first one is, it will provide strength to the threading wall & second one is if any water leakage from the wall then for an instant it will block the leakage to reach to the MCPCB 118 of LEDs.

The gasket face 702B includes at least two fastener holes 702D to allow the fasteners to be inserted into the fastener holes 702D to abut against the wall or the junction box 602 mounted on the wall. Further, a wall mount element 702E formed on the base 702A and extending vertically from the base 702A in such a way that the wall mount element 702E includes internally threaded region 702F in vertical down position and parallel to the wall. The internal threading at the threaded region 702F is a standard thread and can be used with many fixtures available in the market along with silicon gasket 604.

The wall mount element 702E is at a predefined angle from the horizontal plane of the base 702A of the wall mounting adapter 702. In an example as shown in FIG. 7B, the predefined angle can be 5.54°. Also, in the assembly shown in FIG. 7C, two silicon gaskets 604 are used at indicated position to provide watertight sealing, which provides safety to the LED luminaire 100, in addition to the standard threaded connection at the internal wall of each of wall mounting adapter and the ceiling mount junction box for tight sealing.

In an alternative embodiment shown in FIGS. 8A-8C, the internally threaded mounting unit is a hanging mounting unit 802 which has internally threaded region 802A to mate with the externally threaded formation 102C of the LED luminaire 100. As shown in FIG. 8D, the hanging mounting unit 802 has same standard thread 802A inside the body for mechanical fitting, which will not allow the LED luminaire 100 to slip off from the hanging mounting unit 802 in any critical situation.

The hanging mounting unit 802 is bell-shaped and can be hanged, like pendant light, from its top using cable gland 802B or any other suitable means. The profile of the hanging mounting unit 802 is so designed that when the hanging mounting unit 802 used with an E26 base holder like poultry farm application, then hanging mounting unit 802 has enough space to fit inside a regular bulb holder with rotating along it, which is automatically fit in holder up to the marked distance. The hanging mounting unit 802 includes a hanging hook 802C for getting hanged using a hanging medium 802D such as wire or thread.

As shown in FIG. 8C, with the option of the E26 cap, the hanging mounting unit 802 can be directly used as a complete LED bulb cum fixture. In an example, PG7 gland nut can be mechanically locked inside the provision provided in the hanging mounting unit 802. Such provision in the hanging mounting unit 802 will not allow the nut to move with any external torque on it.

In an alternative embodiment, the internally threaded mounting unit is a metallic disc plate 902 having at least two fastener holes 902A and 902B to allow the fasteners 110 to be inserted into the fastener holes 902A, 902B to abut against the ceiling. Thus, with the help of thread available on LED luminaire 100, metallic screw 110 & metallic disc plate 902 can directly fit under any kind of hood. In an example, a silicon gasket can be used between the LED luminaire and the metallic disc plate 902 for watertight sealing so as to restrain any steam or water droplets from coming in contact with the MCPCB 118 of LEDs.

Further, it will be appreciated that those skilled in the art will be able to devise various arrangements that, although not explicitly described or shown herein, embody the principles of the invention and are included within its scope.

Furthermore, all examples recited herein are principally intended expressly to be only for pedagogical purposes to aid the reader in understanding the principles of the invention and the concepts contributed by the inventor(s) to furthering the art and are to be construed as being without limitation to such specifically recited examples and conditions. Also, the various embodiments described herein are not necessarily mutually exclusive, as some embodiments can be combined with one or more other embodiments to form new embodiments.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

We claim:

1. A light emitting diode (LED) luminaire (100) comprising:

a cylindrical plastic housing (102) having a first open end (102A) and a second open end (102B), wherein an externally threaded formation (102C) terminating with a flange (102D) is formed at the first open end (102B) to mate with an internally threaded mounting unit, wherein an internal ridge (102E) is formed at the second open end (102B), and wherein at base of the internal ridge (102E), a circumferential groove (102F) is formed;

an aluminum heat sink (104) insert moulded inside the cylindrical plastic housing (102), the aluminum heat sink (104) having a cylindrical profile matching with the internal profile of the plastic housing (102), wherein the aluminum heat sink (104) having an open end (104A) towards the first open end (102A) of the plastic housing (102) and a closed end (104B) resting on the internal ridge (102E) at the second open end (102B) of the plastic housing (102);

a printed circuit board (PCB) holder plate (106) locking a PCB driver (108) with the interior surface of the closed end (104B) of the aluminum heat sink (104);

a metal core PCB (MCPCB) (118) for LED mounted at an exterior surface of the closed end (104B) of the aluminum heat sink (104) and connected to the PCB driver (108) for receiving driving current; and a plastic diffuser (120) mechanically locked in the circumferential groove (102F) formed at the base of the internal ridge (102E) so as to cover the MCPCB (118)

for LED, wherein the groove (102F) is filled with silicone glue all around to make this water and vapor tight.

2. The LED luminaire (100) as claimed in claim 1, wherein the LED luminaire (100) comprises an electrical connector (112) connecting power supplying insulated wires (114) with the PCB driver (108).

3. The LED luminaire (100) as claimed in claim 2, wherein the insulated wires (114) are connected directly to a power source or connected through a lamp holder.

4. The LED luminaire (100) as claimed in claim 1, wherein the PCB holder plate (106) comprises a circular base (106A) for holding the PCB driver (108), and wherein the circular base (106A) includes:

two pillars (106B) on which the PCB driver (108) is mechanically locked using fasteners (110); and three tower shaped legs (106C) which are mechanically locked with the interior surface of the closed end (104B) of the aluminum heat sink (104) using the fasteners (110).

5. The LED luminaire (100) as claimed in claim 1, wherein the internally threaded mounting unit is a cylindrical plastic adapter (502) formed with at least two bosses (504A, 504B) with respective fastener holes to allow fasteners (110) to be inserted into the fastener holes to abut against a metallic junction box (506).

6. The LED luminaire (100) as claimed in claim 1, wherein the internally threaded mounting unit is a cylindrical plastic junction box (602) having an open end (602A) and a closed end (602B), the cylindrical plastic junction box (602) comprising:

at least two flanges (602C, 602D) at a base formed at the closed end (602B), wherein the at least two flanges (602C, 602D) include fastener holes (602CC, 602DD) to allow fasteners (110) to be inserted into the fastener holes (602CC, 602DD) to abut against a ceiling or a wall;

at least four fastener holes (602E) formed on the base to allow the fasteners (110) to be inserted into the fastener holes (602E) to abut against the ceiling or the wall;

at least four PVC conduit fitting slots (602F) in walls of the junction box (602);

a gasket face (602G) on the one end of the junction box (602), wherein the gasket face (602G) protrudes outside the walls of the junction box (602);

at least twelve ribs (602H) formed below the gasket face (602H) on the walls to provide strength to the gasket face (602H); and at least four bosses (602I) formed on the gasket face (602H) with respective fastener holes to allow the fasteners (110) to be inserted into the fastener holes to abut a wall mounting adapter with the junction box (602).

7. The LED luminaire (100) as claimed in claim 6, wherein the internally threaded mounting unit is a wall mounting adapter (702) which is directly fixed on the wall or fixed on the wall through the cylindrical plastic junction box (602), and wherein the wall mounting adapter (702) comprising:

a circular base (702A) mechanically mountable on the wall directly or through the cylindrical plastic junction box (602);

a gasket face (702B), formed on the circular base (702A), on a side facing the wall or the cylindrical plastic junction box (602), wherein the gasket face (702B) includes at least two circular ribs (702C) at gasket fitting section for tight mounting, and wherein the the gasket face (702B) includes at least two fastener holes (702D) to allow the fasteners (110) to be inserted into the fastener holes (702D) to abut the wall mounting adapter (702) against the wall or the cylindrical plastic junction box (602) mounted on the wall; and a wall mount element (702E) formed on the base (702A) and extending vertical from the base (702A) in such a way that the wall mount element (702E) includes internally threaded region in vertical down position and parallel to the wall, wherein the wall mount element (702E) is at a predefined angle from horizontal plane of the base (702A) of the wall mounting adapter (702).

8. The LED luminaire (100) as claimed in claim 1, wherein the internally threaded mounting unit is a hanging mounting unit (802) which has internally threaded region (802A) to mate with the externally threaded formation (102C) of the plastic housing (102), wherein the hanging mounting unit (802) is bell-shaped and is hanged from its top using cable gland (802B), and wherein the hanging mounting unit (802) includes a hanging hook (802C) for getting hanged using handing medium (802D).

9. The LED luminaire (100) as claimed in claim 1, wherein the internally threaded mounting unit is a metallic disc plate (902) having at least two fastener holes (902A, 902B) to allow the fasteners (110) to be inserted into the fastener holes (902A, 902B) to abut against the ceiling.

* * * * *